US007028593B1

(12) United States Patent
Lin et al.

(10) Patent No.: US 7,028,593 B1
(45) Date of Patent: Apr. 18, 2006

(54) SCREWDRIVER WITH REVOLVING CYLINDER CONTAINING REPLACEABLE SCREWDRIVER TIPS

(75) Inventors: Shu-Sui Lin, Taichung (TW); Hong-Chow Yu, No 28 Lane 157 Young Hsin rd, Ta-Li City, Taichung (TW)

(73) Assignees: A. A. G. Industrial Co. Ltd, Taichung (TW); Hong-Chow Yu, Taichung (TW)

( * ) Notice: Subject to any disclaimer, the term of this patent is extended or adjusted under 35 U.S.C. 154(b) by 0 days.

(21) Appl. No.: 11/160,727

(22) Filed: Jul. 6, 2005

(51) Int. Cl.
*B25B 23/00* (2006.01)

(52) U.S. Cl. ..... 81/439; 81/177.4; 81/490

(58) Field of Classification Search ..... 81/438, 81/439, 437, 436, 177.4, 490
See application file for complete search history.

(56) References Cited

U.S. PATENT DOCUMENTS 5,740,706 A * 4/1998 Tseng ..... 81/490
6,134,995 A * 10/2000 Shiao ..... 81/439
6,138,537 A * 10/2000 Cole ..... 81/439
6,327,942 B1 * 12/2001 Mariol et al. ..... 81/177.4
6,928,908 B1 * 8/2005 Yu ..... 81/490

* cited by examiner

*Primary Examiner*—Jacob K. Ackun, Jr.
(74) *Attorney, Agent, or Firm*—W. Wayne Liauh

(57) ABSTRACT

Provided is a screwdriver comprising a pivotal removable revolving cylinder containing screwdriver tips a pivot bucket with the revolving cylinder disposed therein, and a flexible limiting member fastened at either cut on the shank of a handle for fastening the handle in its operation or storage position. In a revolving cylinder replacement operation pull the handle rearward to disengage the shank with the revolving cylinder, pull the pivot bucket upward by pivoting until it is disposed externally of a slot in a body, remove a pivot pin for replacing the revolving cylinder, mount the revolving cylinder in the pivot bucket, and pivot the pivot bucket downward to dispose in the slot again.

1 Claim, 14 Drawing Sheets

B – B

A – A

SCREWDRIVER WITH REVOLVING CYLINDER CONTAINING REPLACEABLE SCREWDRIVER TIPS

BACKGROUND OF THE INVENTION

1. Field of Invention

The present invention relates to screwdrivers and more particularly to such a screwdriver having a revolving cylinder containing replaceable screwdriver tips with improved characteristics.

2. Related Art

A conventional screwdriver having a revolving cylinder containing replaceable screwdriver tips is shown in FIGS. 1, 2, and 3. The screwdriver comprises a body 1, a handle 2, a revolving cylinder 3, and a shell 4. The body 1 comprises a space 11 having a slot 12, a ratchet wheel 13 in a forward end, a sleeve 14 extended forwardly from the ratchet wheel 13, a rear guide tube 15 having a plurality of dents 16, a pipe 17 extended through the guide tube 15 and the space 11, and a cylinder 18 put on the pipe 17. A magnet 25 is provided proximate a front end of the sleeve 14. The revolving cylinder 3 comprises an end projection 31 having a plurality of holes 32 for containing a plurality of screwdriver tips A, an annular flange 33 in the intermediate portion, and a plurality of grooves 34 equally spaced around the other end. The shell 4 comprises two halves 41 formed together by electron-beam welding with the revolving cylinder 3 enclosed therein. Each half 41 comprises a bottom recess 42 with the projection 31 received therein, a spring 43 and a steel ball 44 provided on the recess 42, a half circular trough 45 with the flange 33 received therein, a half circular opening 46 on the bottom such that a screwdriver tip A is able to access through the a complete circular opening 46, a sliding block 47 on an underside adapted to slide in the slot 12 such that a shank 21 is adapted to pass the hole 32 to retain the revolving cylinder 3 in the space 11. In use, a user may turn the revolving cylinder 3 to select a desired screwdriver tip A. Once selected, push the handle 2 forward to project the screwdriver tip A from a front end of the sleeve 14. Thus, the user can insert the screwdriver tip A in a slot in the head of a screw.

But this is unsatisfactory for the purpose for which the invention is concerned for the following reasons:

(a) The shank 21 may clear both the revolving cylinder 3 and the shell 4. Thus, both the revolving cylinder 3 and the shell 4 tend to fall on the ground due to no fastening.

(b) Two halves 41 of the shell 4 are formed together by electron-beam welding with the revolving cylinder 3 enclosed therein. Thus, the shell 4 must be replaced together if only revolving cylinder 3 is required to replace. This inevitably increases the manufacturing cost. In addition, the forming of the shell 4 with the revolving cylinder 3 enclosed therein is a time consuming process.

(c) Forming of a steel ball 22, a spring 23, and a cap 24 on a front end of the handle 2 and the forming of the dents 16 in which one of the dents 16 is adapted to receive the spring biased steel ball 22 for positioning is a time consuming process of assembly.

(d) Forming of the grooves 34 equally spaced around the other end of the revolving cylinder 3 and the associated spring 43 and the steel ball 44 positioned in one of the grooves 34 is a time consuming process of assembly. Thus, the need for improvement still exists.

SUMMARY OF THE INVENTION

It is therefore an object of the present invention to provide a screwdriver comprising a revolving cylinder having a plurality of lengthwise screwdriver tip receiving holes equally spaced around its central bore, and a plurality of parallel, lengthwise troughs formed on its surface; a body including a forward ratchet wheel, a sleeve projected from the ratchet wheel, a rear slot in communication with the sleeve, a projection disposed at one side of the slot, a pivot bucket disposed in the slot and hingedly connected to the projection, the pivot bucket including a removable pivot pin pivotably disposed across one end thereof, the central bore of the revolving cylinder, and the other end thereof, and two openings at both ends, a detent disposed between the pivot bucket and the revolving cylinder and including a resilient member having a plurality of protrusions on its surface, the protrusions being adapted to fit in the troughs, a rear tube in communication with the slot, a slit disposed on the tube, and a flexible limiting member inserted into the slit, the limiting member including a central aperture; and a handle including a forward shank inserted into the tube, a magnet formed on a front end of the shank, and a limiting mechanism disposed on the shank and including an annular forward first cut and an annular rear second cut wherein in a ready to use position the shank is adapted to pass through one opening and the receiving hole to push a screwdriver tip engaged the magnet out of the receiving hole and the other opening to dispose at a front end of the sleeve, and the second cut is anchored in the aperture, wherein: in a screwdriver tip change operation in the ready to use position, pull the handle rearward until the screwdriver tip is retracted into the receiving hole, the shank disengages the revolving cylinder, and the first cut is anchored in the aperture, turn the revolving cylinder about the pivot pin engage the protrusions with the aligned troughs with the screwdriver tip to be selected aligned with the openings, and push the shank to move the screwdriver tip out of the revolving cylinder and the other opening to dispose at the front end of the sleeve in the ready to use position again; in a screwdriver tip replacement operation in the ready to use position, pull the handle rearward to disengage the shank with the revolving cylinder, pull the pivot bucket upward to cause the pivot bucket to pivot about the projection until the openings are disposed externally of the slot, turn the revolving cylinder for aligning the screwdriver tip to be replaced with the openings, pull the screwdriver tip out of the other opening for removal, insert another screwdriver tip into the receiving hole through the other opening, and pivot the pivot bucket downward to dispose in the slot again; and in a revolving cylinder replacement operation pull the handle rearward to disengage the shank with the revolving cylinder, pull the pivot bucket upward by pivoting until it is disposed externally of the slot, remove the pivot pin for replacing the revolving cylinder, mount the revolving cylinder in the pivot bucket, and pivot the pivot bucket downward to dispose in the slot again.

The above and other objects, features and advantages of the present invention will become apparent from the following detailed description taken with the accompanying drawings.

DETAILED DESCRIPTION OF THE INVENTION

Figure 1:
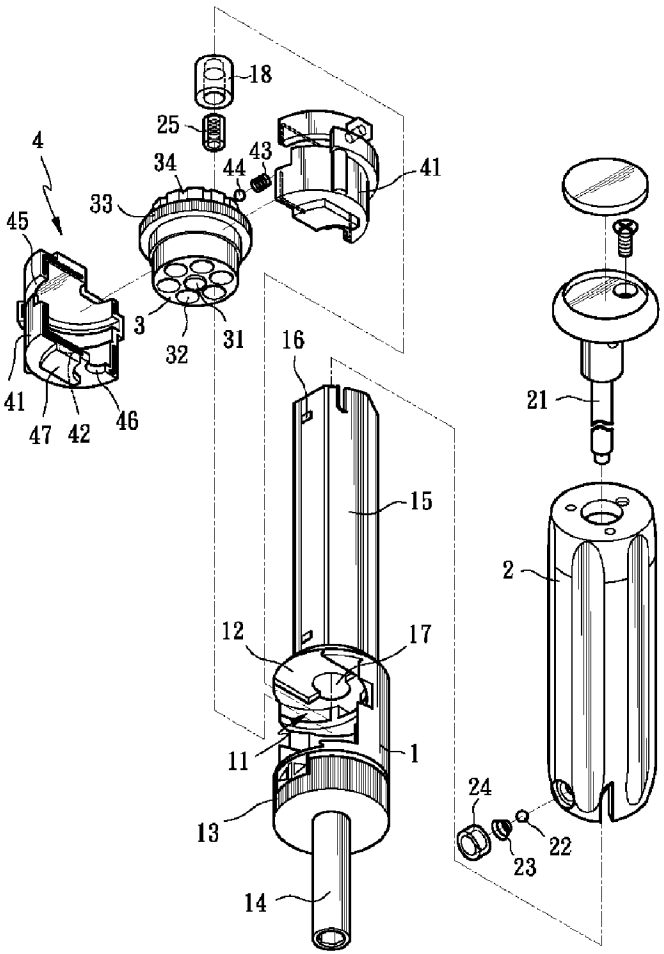
FIG. 1 PRIOR ART
FIG. 1 is a perspective view of a conventional screwdriver with a revolving cylinder.
Figure 2:
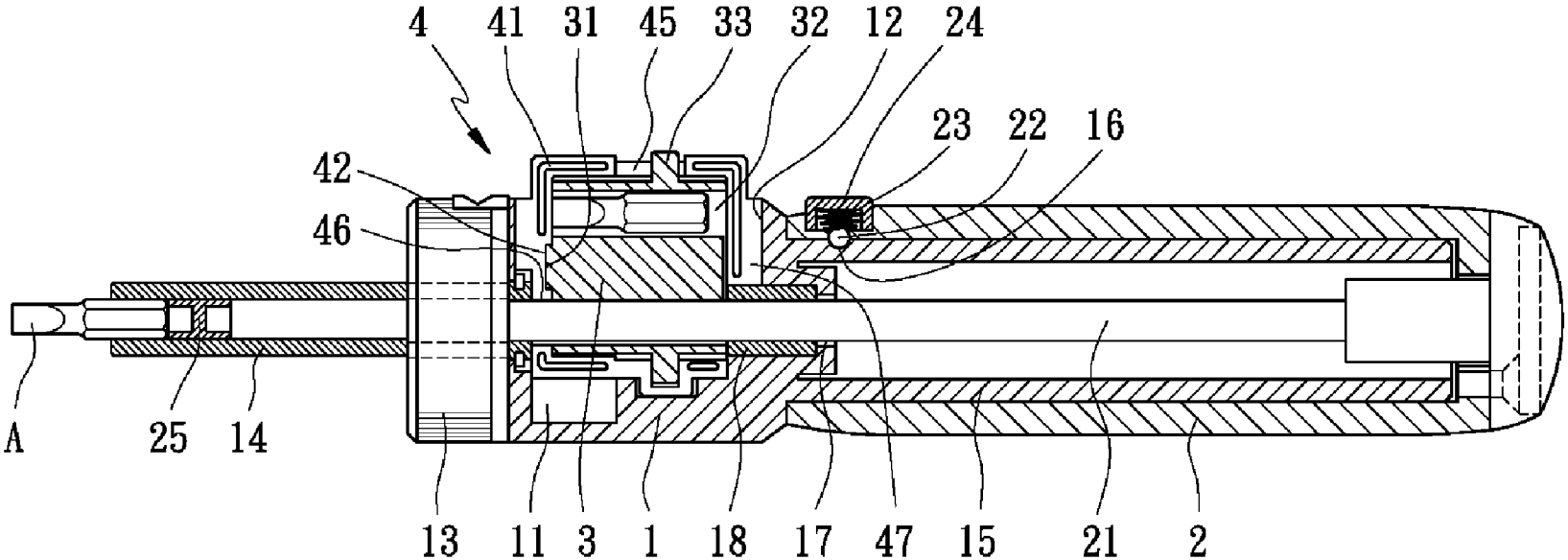
FIG. 2 PRIOR ART
FIG. 2 is a sectional view of the assembled screwdriver in FIG. 1 in its ready to use position.
Figure 3:
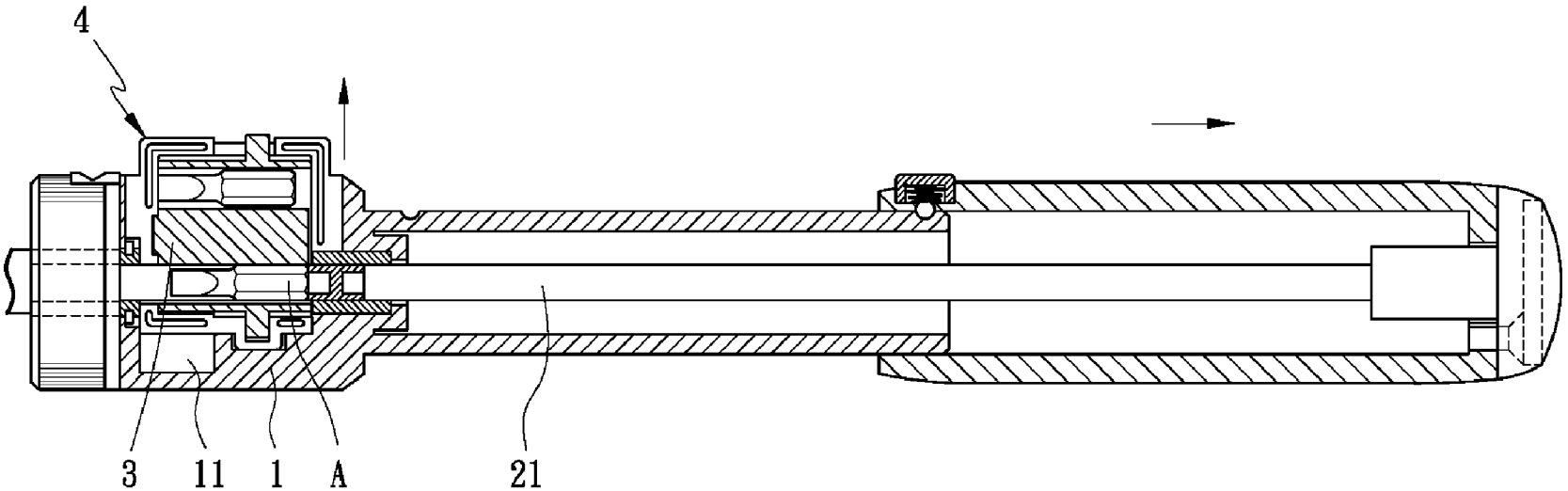
FIG. 3 PRIOR ART
FIG. 3 is a view similar to FIG. 2 where the screwdriver is in its inoperative position.
Figure 4:
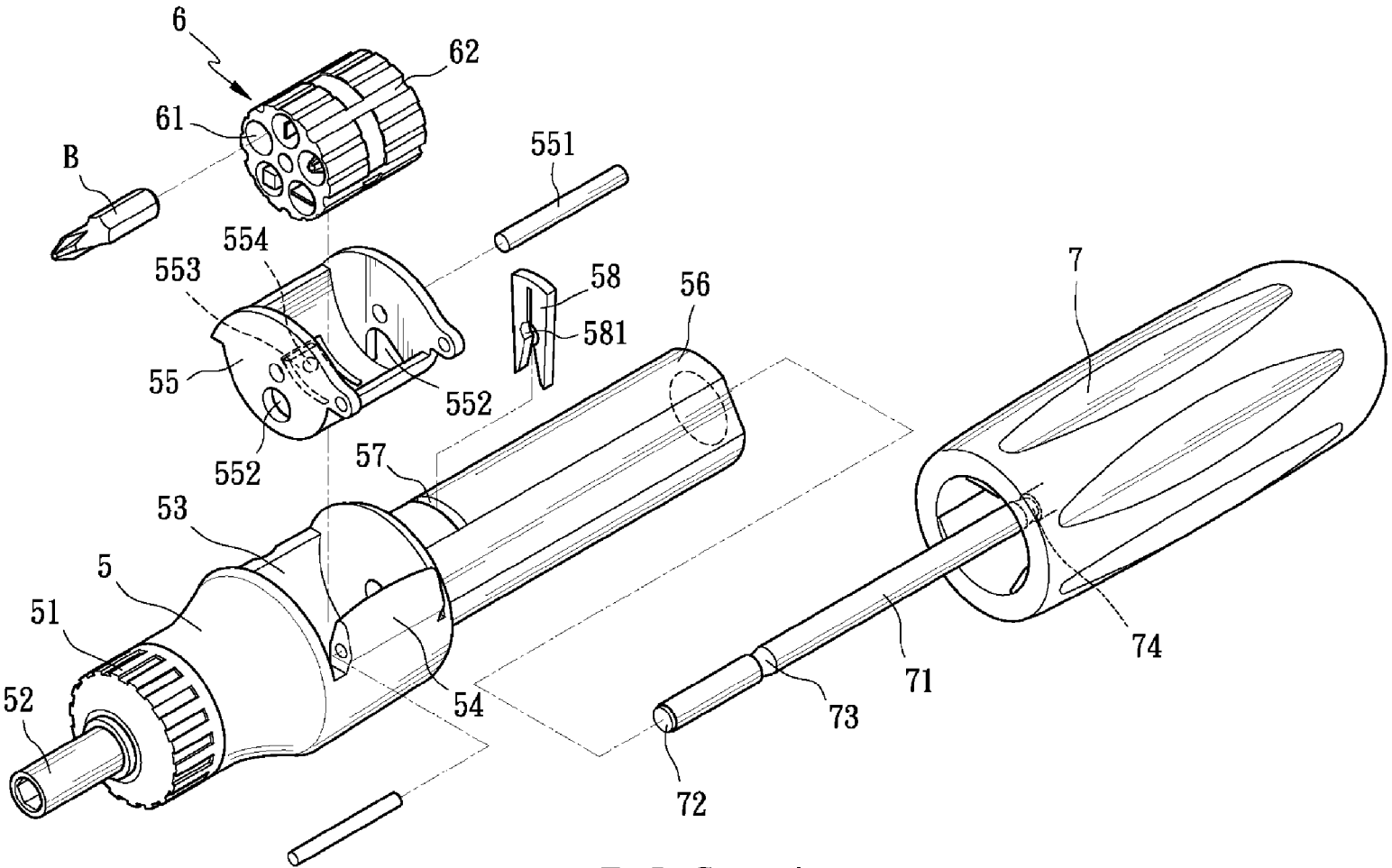
FIG. 4 is an exploded view of a preferred embodiment of screwdriver according to the invention.
Figure 5:
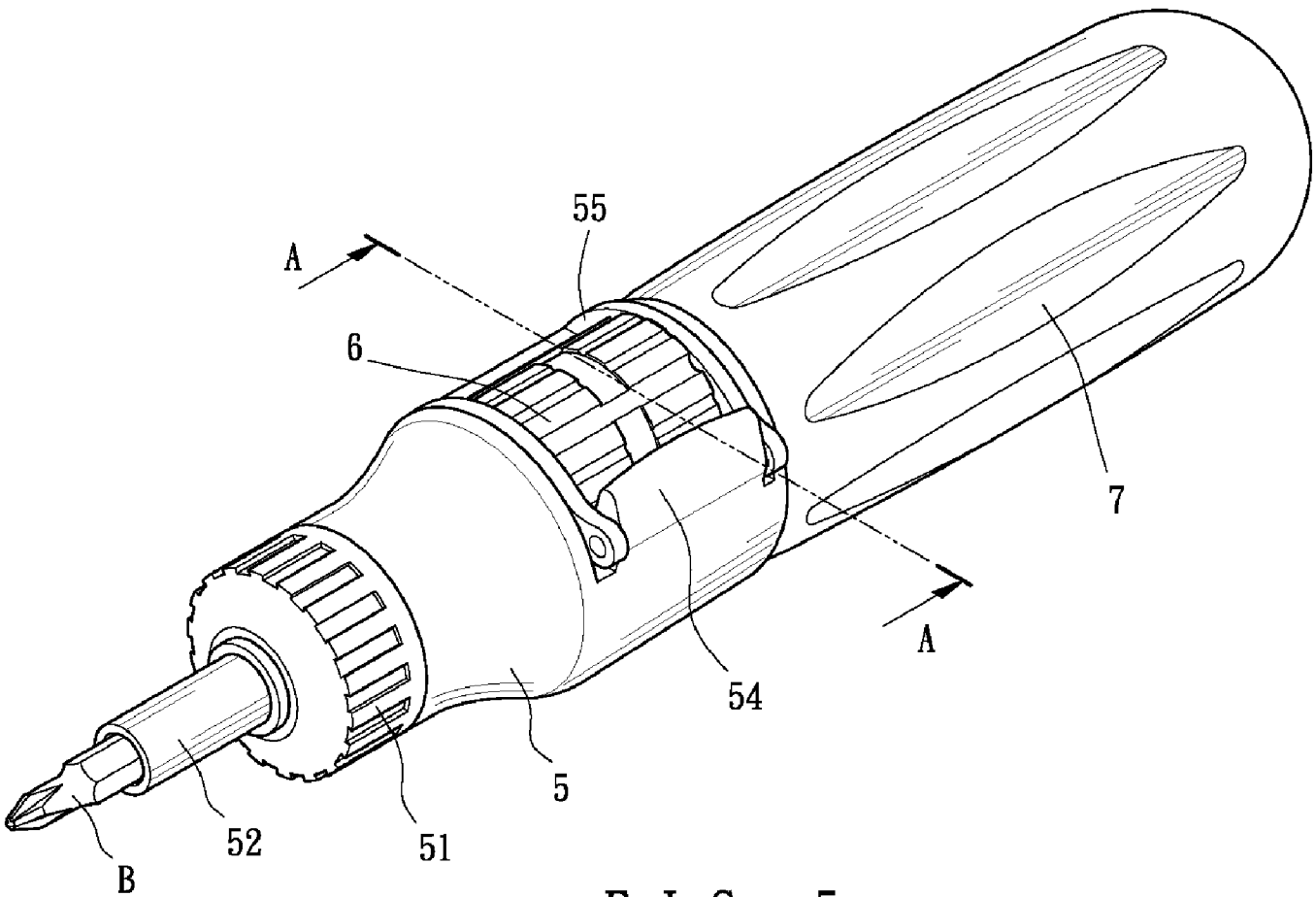
FIG. 5 is a perspective view of the assembled screwdriver in FIG. 4.
Figure 6:
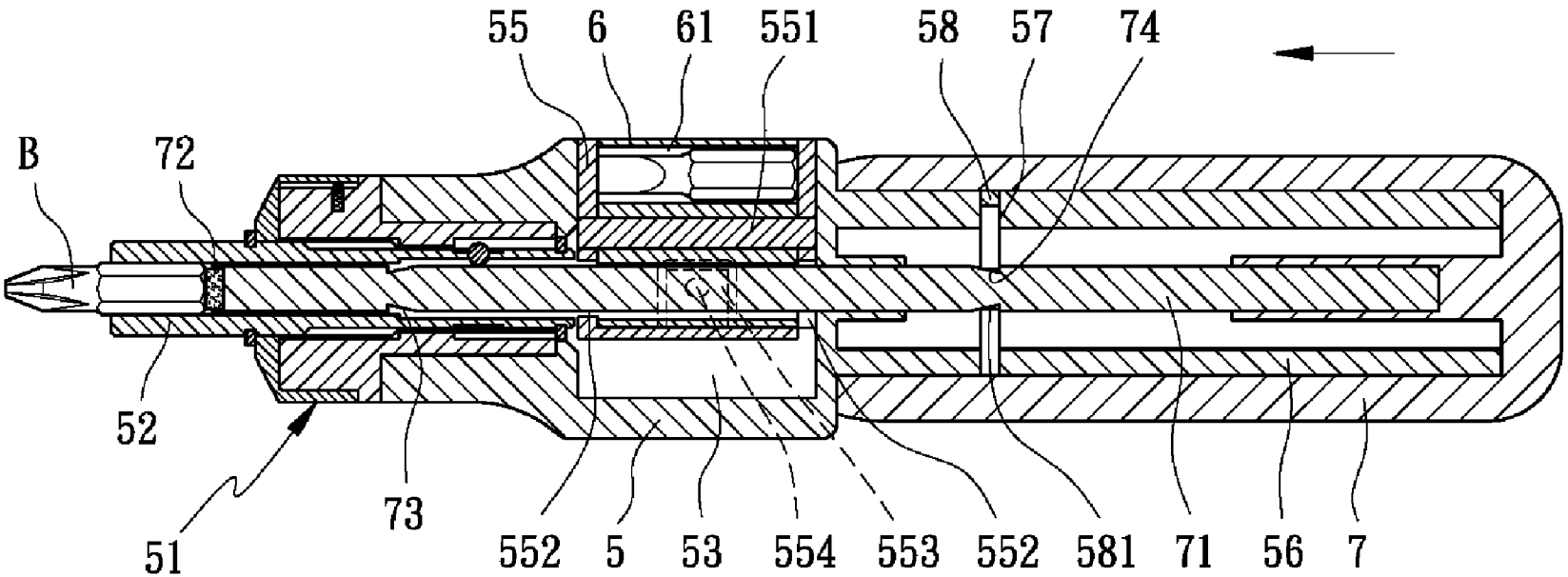
FIG. 6 is a lengthwise sectional view of FIG. 5.
Figure 11:
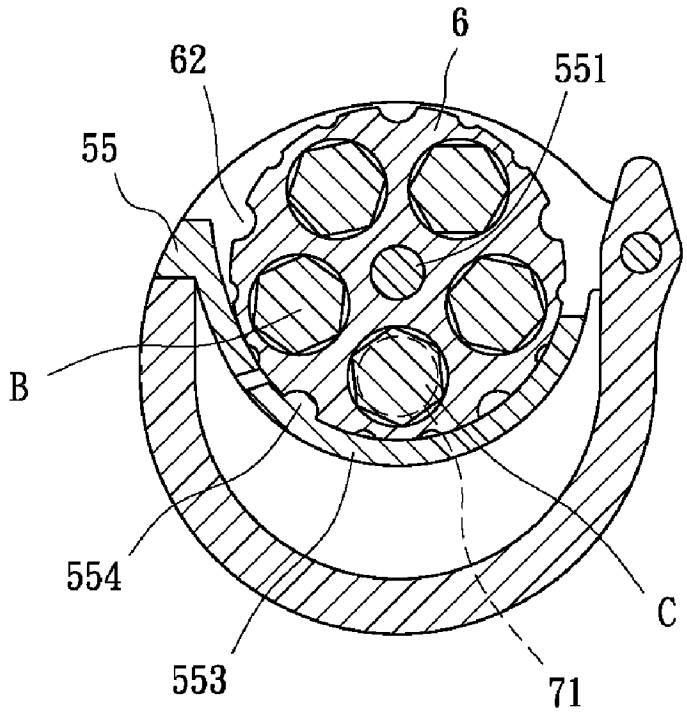
FIG. 11 is a sectional view taken along line B—B of FIG. 10.
Figure 7:
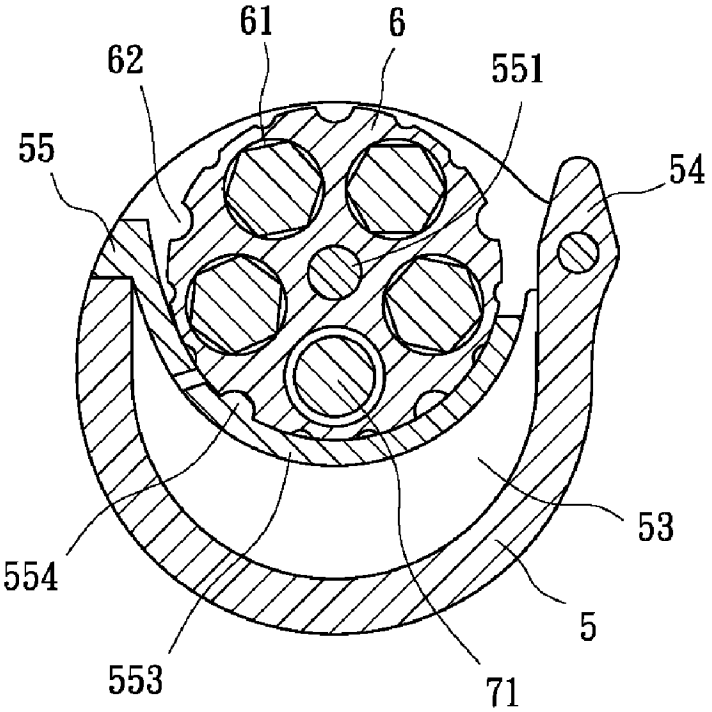
FIG. 7 is a sectional view taken along line A—A of FIG. 5.

Referring to FIGS. 4 to 7, a screwdriver in accordance with a preferred embodiment of the invention is shown. The screwdriver comprises a body 5 including a forward ratchet wheel 51, a sleeve 52 projected from the ratchet wheel 51, a rear slot 53 in communication with the sleeve 52, a projection 54 at one side of the slot 53, a pivot bucket 55 provided in the slot 53 and hingedly connected to the projection 54, the pivot bucket 55 including a removable pivot pin 551 pivotably disposed across one end, a central bore of a revolving cylinder 6 having a plurality of lengthwise screwdriver tip (e.g., Phillips tip B) receiving holes 61 equally spaced around its central bore, and the other end, and two openings 552 at both ends aligned with one of the receiving holes 61. A detent is provided between the pivot bucket 55 and the revolving cylinder 6 for positioning the revolving cylinder 6. The detent comprises a resilient member 553 and a plurality of protrusions 554 on a surface of the resilient member 553. A plurality of parallel, lengthwise troughs 62 are formed on a surface of the revolving cylinder 6. The protrusions 554 are adapted to fit in the troughs 62. A rear tube 56 is in communication with the slot 53. A handle 7 has a shank 71 inserted into the tube 56. A magnet 72 is formed on a front end of the shank 71. A limiting mechanism is provided on the shank 71 and comprises an annular forward first cut 73 and an annular rear second cut 74. A slit 57 is provided on the tube 56. A flexible limiting member 58 having a central aperture 581 is inserted into the slit 57. The handle 7 is adapted to slide away from the tube 56 to anchor the aperture 581 around the first cut 73. As a result, the handle 7 is prohibited from moving out of its desired position.

In use, push the handle 7 forward to cause the shank 71 to expand the aperture 581 of the limiting member 58. Thus, the shank 71 is free to move. Next, the shank 71 moves through one opening 552 and the receiving hole 61 to push the screwdriver tip B out of the receiving hole 61 and the other opening 552 (i.e., the screwdriver tip B clears the revolving cylinder 6). Eventually, the screwdriver tip B is projected from a front end of the sleeve 52 with the second cut 74 anchored in the aperture 581 for positioning.

Figure 8:
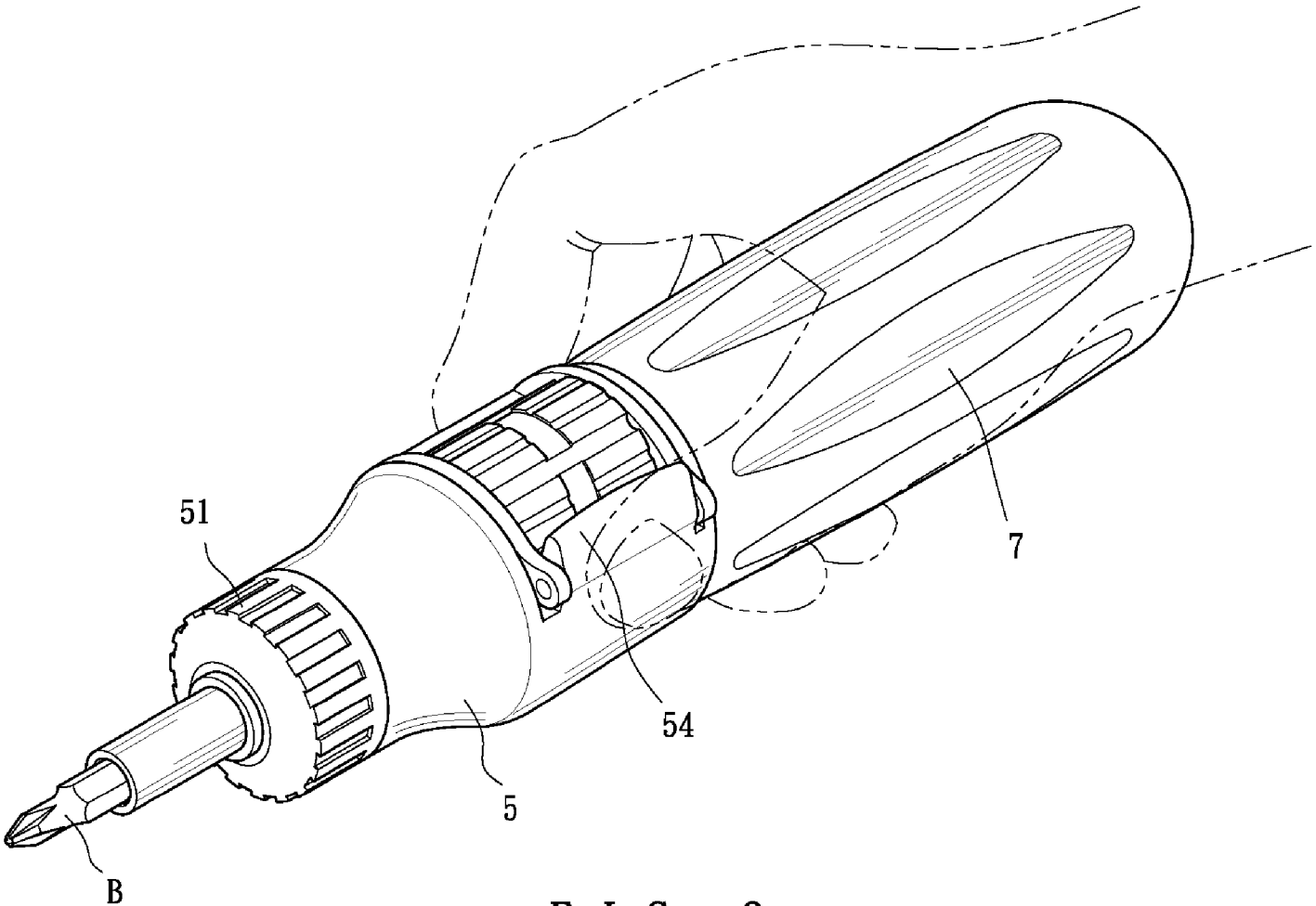
FIG. 8 is a view similar to FIG. 5 where the screwdriver is held by the hand in a ready to use position.

Referring to FIG. 8, in selecting a desired screwdriver tip a user may hold the handle 7 to continuously turn the body 5 by holding the projection 54 with the thumb. Thus, the projection 54 serves as an auxiliary means for turning the body 5 in cooperation with the ratchet wheel 51.

Referring to FIGS. 9 to 12, in a screwdriver tip change operation a user may pull the handle 7 rearward until the screwdriver tip B is retracted into the receiving hole 61 by attracting the screwdriver tip B by the magnet 72. Next, disengage the shank 71 with the revolving cylinder 6. It is configured that the revolving cylinder 6 pivots about the pivot bucket 55 and the pivot bucket 55 pivots about the body 5. Thus, both the revolving cylinder 6 and the pivot bucket 55 are prevented from disengaging the body 5. Also, the aperture 581 is anchored around the first cut 73 for fastening both the shank 71 and the handle 7. Thus, for selecting a desired screwdriver tip C the user can turn the revolving cylinder 6 about the pivot pin 551. The resilient member 553 thus pivots same. Next, engage the protrusions 554 with the aligned troughs 62 and the desired screwdriver tip C is thus aligned with the opening 552. Next, push the shank 71 to move the screwdriver tip C out of the revolving cylinder 6 and the opening 552 to project from the sleeve 52. This completes the screwdriver tip change operation.

Figure 9:
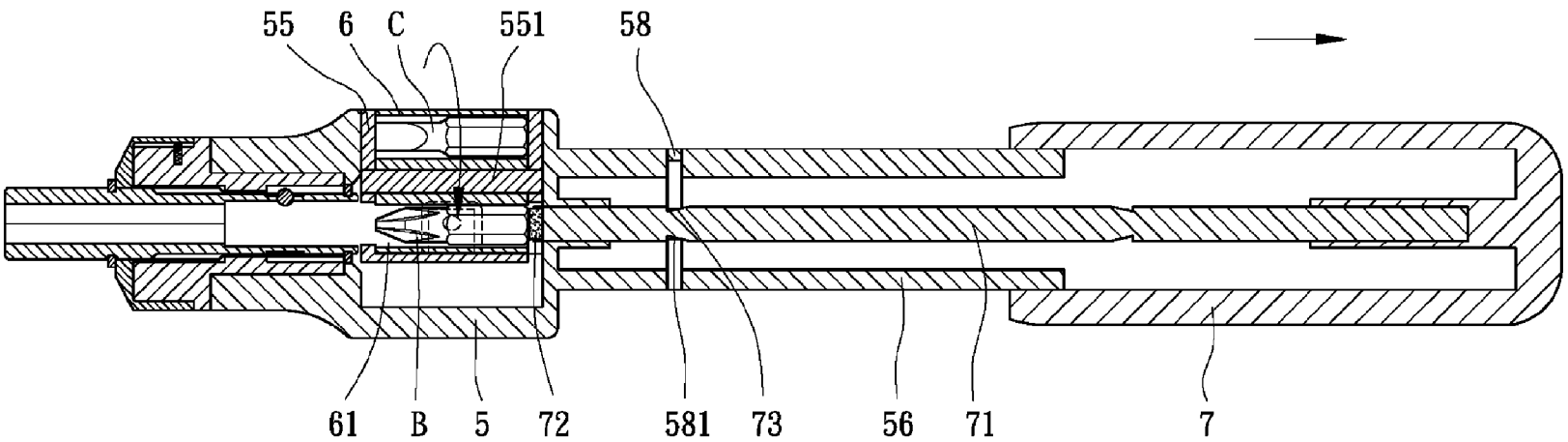
FIGS. 9 and 10 are lengthwise sectional views of FIG. 5 in a screwdriver tip change operation.
Figure 10:
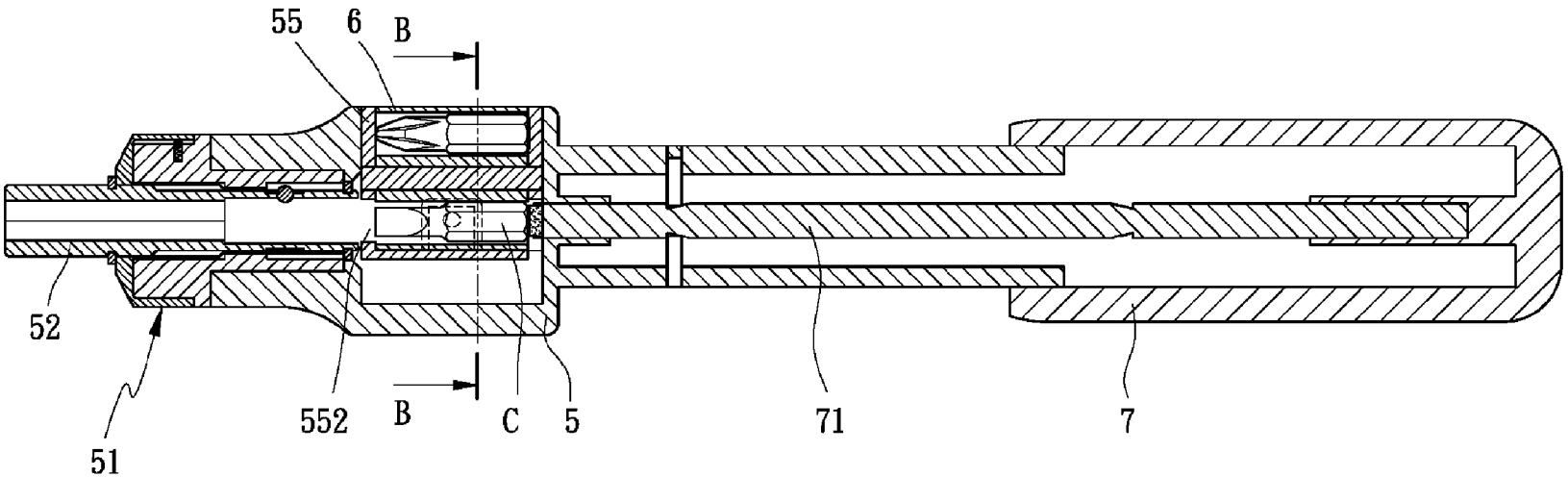
Figure 12:
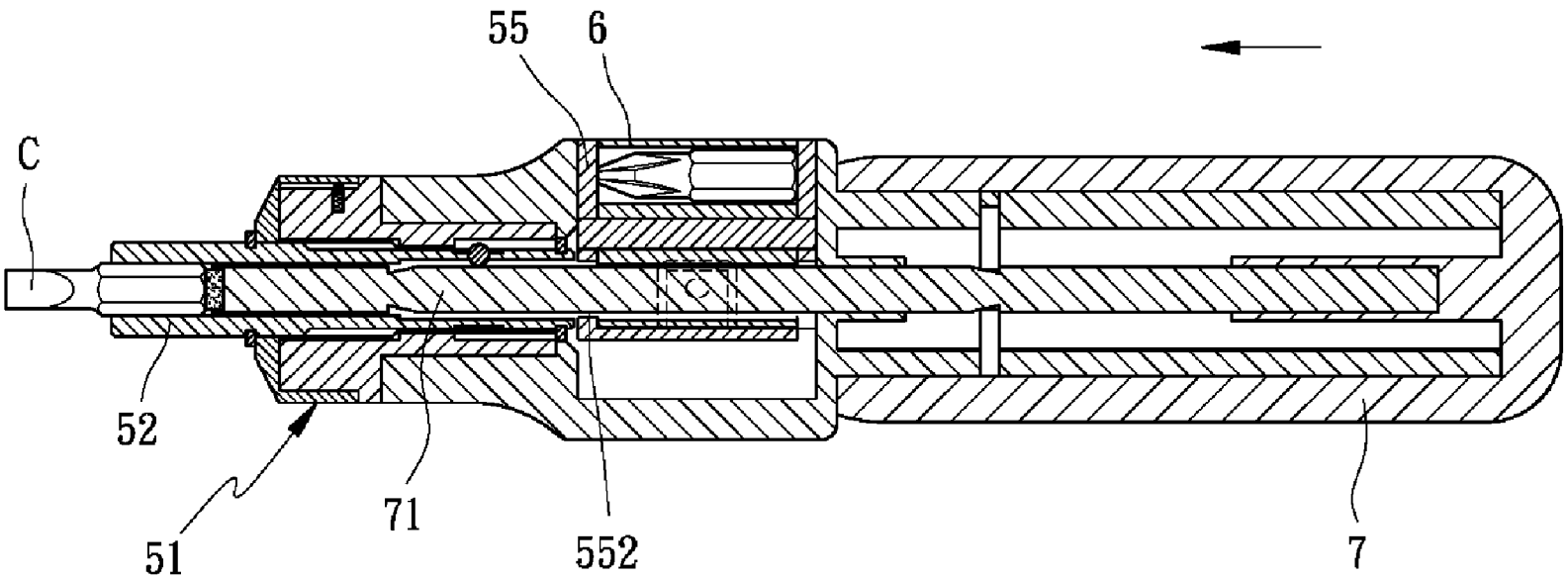
FIG. 12 is a lengthwise sectional view of FIG. 5 where a desired screwdriver tip has been selected and pushed in place.
Figure 13:
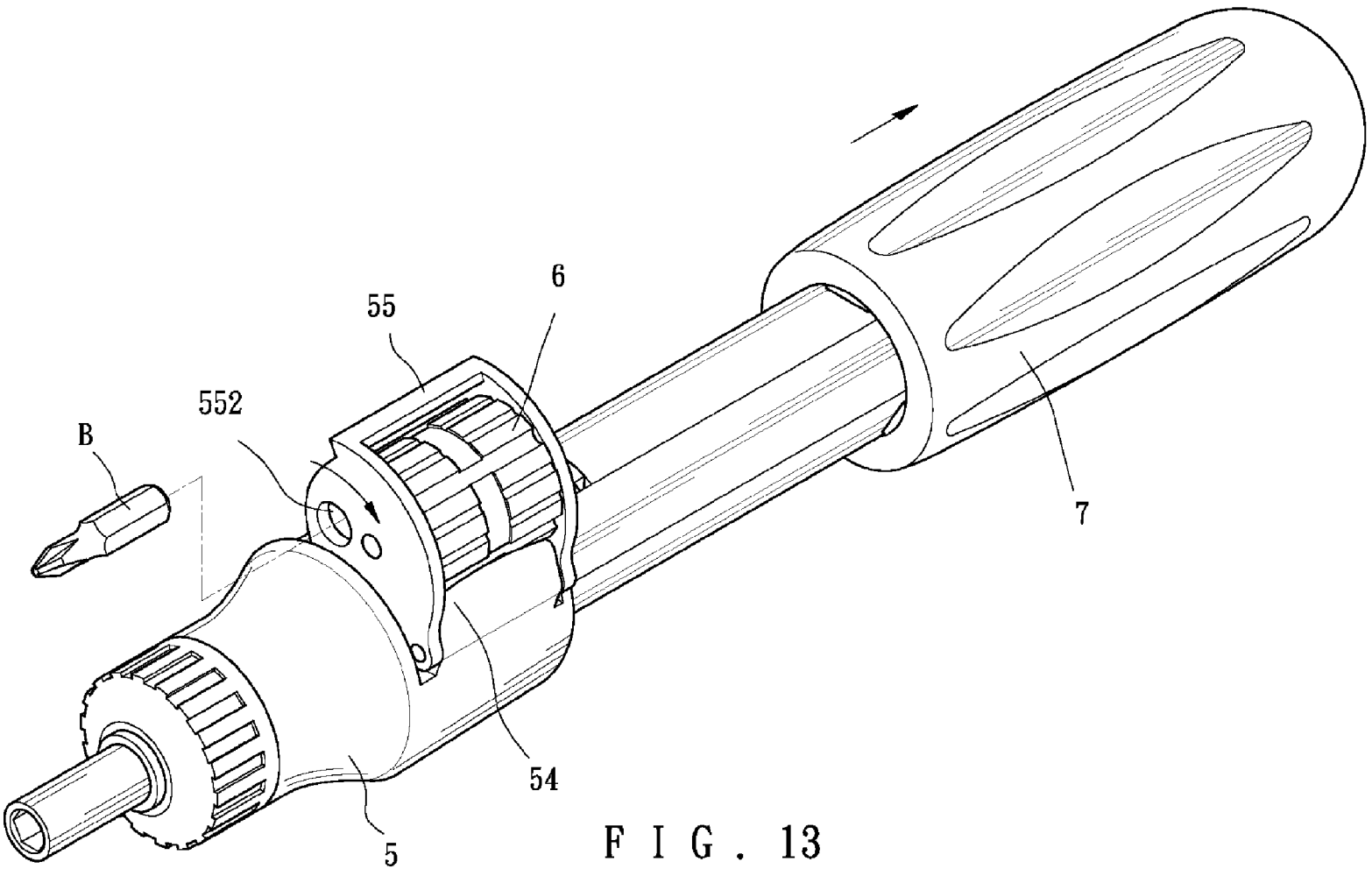
FIGS. 13 and 14 are perspective views showing a screwdriver tip replacement operation.
Figure 14:
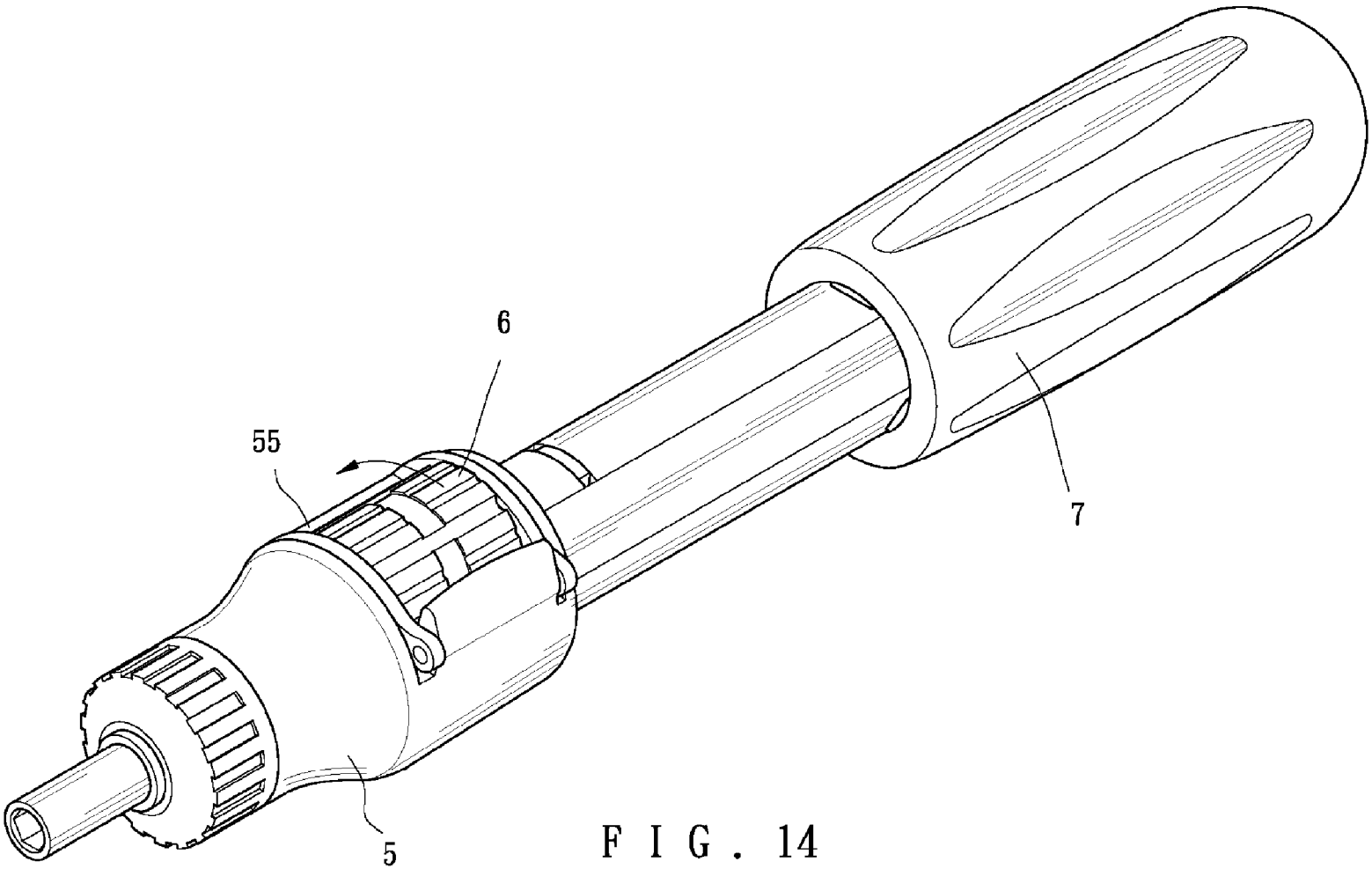

Referring to FIGS. 9, 13, and 14, in an operation of replacing a screwdriver tip B in the revolving cylinder 6, a user may pull the handle 7 rearward to disengage the shank 71 with the revolving cylinder 6. Next, pull the pivot bucket 55 upward and the pivot bucket 55 thus pivots about the projection 54 until the openings 552 are disposed externally of the slot 53. Next, turn the revolving cylinder 6 for aligning the screwdriver tip B with the opening 552. Next, pull the screwdriver tip B out of the other opening 552 for removal and next insert another screwdriver tip into the receiving hole 61 through the other opening 552. After replacement, pivots the pivot bucket 55 downward to dispose in the slot 53 again.

Figure 15:
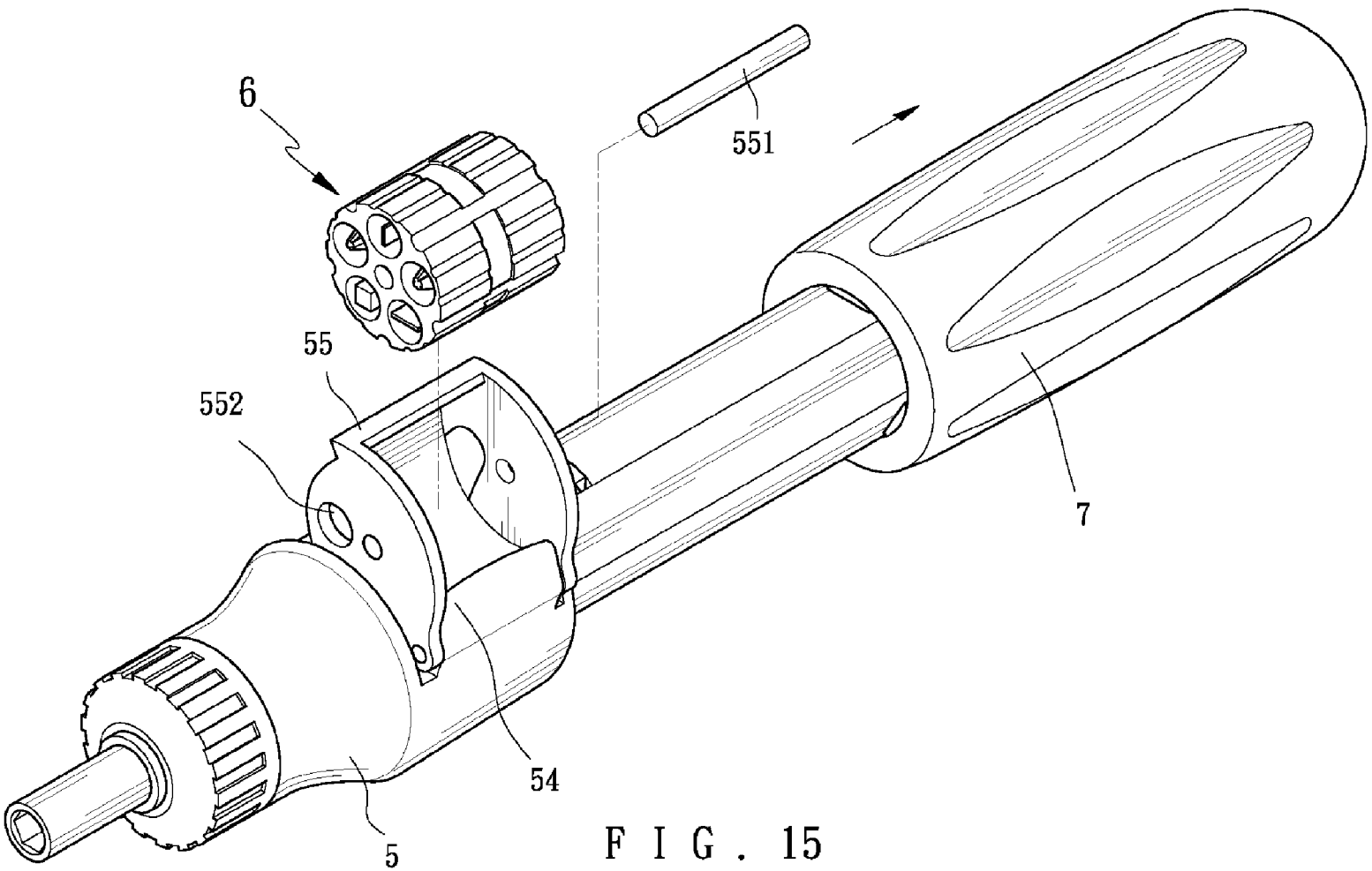
FIG. 15 is a perspective view showing a revolving cylinder replacement operation.

Referring to FIGS. 9 and 15 in conjunction with FIGS. 13 and 14, in an operation of replacing the revolving cylinder 6 for using the same type of screwdriver tip, a user may pull both the handle 7 and the shank 71 rearward. Next, pull the pivot bucket 55 upward by pivoting until it is disposed externally of the slot 53. Next, remove the pivot pin 551 in order to replace the revolving cylinder 6. As contemplated by the invention, replacement of the revolving cylinder 6 can be done without replacing any other components (e.g., the pivot bucket 55) since the revolving cylinder 6 is pivotably disposed in the pivot bucket 55 by pivoting about the pivot pin 551. Next, mount the new revolving cylinder 6 in the pivot bucket 55. Finally, pivots the pivot bucket 55 downward to dispose in the slot 53 again.

While the invention herein disclosed has been described by means of specific embodiments, numerous modifications and variations could be made thereto by those skilled in the art without departing from the scope and spirit of the invention set forth in the claims.

What is claimed is:

1. A screwdriver comprising:

a revolving cylinder having a plurality of lengthwise screwdriver tip receiving holes equally spaced around its central bore, and a plurality of parallel, lengthwise troughs formed on its surface;

a body including a forward ratchet wheel, a sleeve projected from the ratchet wheel, a rear slot in communication with the sleeve, a projection disposed at one side of the slot, a pivot bucket disposed in the slot and hingedly connected to the projection, the pivot bucket including a removable pivot pin pivotably disposed across one end thereof, the central bore of the revolving cylinder, and the other end thereof, and two openings at both ends, a detent disposed between the pivot bucket and the revolving cylinder and including a resilient member having a plurality of protrusions on its surface, the protrusions being adapted to fit in the troughs, a rear tube in communication with the slot, a slit disposed on the tube, and a flexible limiting member inserted into the slit, the limiting member including a central aperture; and a handle including a forward shank inserted into the tube, a magnet formed on a front end of the shank, and a limiting mechanism disposed on the shank and including an annular forward first cut and an annular rear second cut wherein in a ready to use position the shank is adapted to pass through one opening and the receiving hole to push a screwdriver tip engaged the magnet out of the receiving hole and the other opening to dispose at a front end of the sleeve, and the second cut is anchored in the aperture, wherein:

in a screwdriver tip change operation in the ready to use position, pull the handle rearward until the screwdriver tip is retracted into the receiving hole, the shank disengages the revolving cylinder, and the first cut is anchored in the aperture, turn the revolving cylinder about the pivot pin engage the protrusions with the aligned troughs with the screwdriver tip to be selected aligned with the openings, and push the shank to move the screwdriver tip out of the revolving cylinder and the other opening to dispose at the front end of the sleeve in the ready to use position again;

in a screwdriver tip replacement operation in the ready to use position, pull the handle rearward to disengage the shank with the revolving cylinder, pull the pivot bucket upward to cause the pivot bucket to pivot about the projection until the openings are disposed externally of the slot, turn the revolving cylinder for aligning the screwdriver tip to be replaced with the openings, pull the screwdriver tip out of the other opening for removal, insert another screwdriver tip into the receiving hole through the other opening, and pivot the pivot bucket downward to dispose in the slot again; and in a revolving cylinder replacement operation pull the handle rearward to disengage the shank with the revolving cylinder, pull the pivot bucket upward by pivoting until it is disposed externally of the slot, remove the pivot pin for replacing the revolving cylinder, mount the revolving cylinder in the pivot bucket, and pivot the pivot bucket downward to dispose in the slot again.

* * * * *